United States Patent [19]

Metcalfe

[11] Patent Number: 4,639,703

[45] Date of Patent: Jan. 27, 1987

[54] SADDLE COILS FOR ELECTROMAGNETIC DEFLECTION UNITS

[75] Inventor: John G. Metcalfe, York, England

[73] Assignee: U.S. Philips Corporation, New York, N.Y.

[21] Appl. No.: 736,909

[22] Filed: May 22, 1985

[51] Int. Cl.[4] ..... H01F 5/02

[52] U.S. Cl. ..... 335/213; 335/210; 79/605

[58] Field of Search ..... 335/210, 213, 299; 29/605; 313/421, 426, 427, 428

[56] References Cited

U.S. PATENT DOCUMENTS

| | | | |
|---|---|---|---|
| 2,831,136 | 4/1958 | Hanlet | 335/213 |
| 3,139,566 | 6/1964 | Marley | 335/213 X |
| 3,702,450 | 11/1972 | Avery et al. | 335/213 |
| 3,754,322 | 8/1973 | Chandler | 335/213 X |

*Primary Examiner*—George Harris

*Attorney, Agent, or Firm*—Thomas A. Briody; William J. Streeter; Leroy Eason

[57] ABSTRACT

A saddle coil for a deflection coil assembly in an electromagnetic deflection unit is formed from a plurality of layer each of which comprises a conductive pattern on an insulating film and may be produced by printed wiring techniques. Each layer is constructed from first (FIG. 3) and second (FIG. 4) lamelliform parts, the first of which is substantially 'U' shaped, these parts being assembled by distorting the shape of the first part and bridging its distal ends, which may have inward facing projections (14A, 15A), with the second part. In the assembled layer (FIG. 5) the transverse limb of the first part is at the gun end (9) and the flared side limbs of this part form the side members (11,12) while the second part forms at least part of the screen end (13). Conductive patterns on the first and second part are interconnected to form a coil. A number of such layers so formed are assembled to produce the saddle coil with the required electrical connections between the layers. Saddle coils produced in this manner have the advantage that the conductors are accurately positioned from coil to coil with a consequence accuracy of deflection.

Two such saddle coils are used to form a deflection coil assembly (line and/or field) which assemblies can be used in the construction of a deflection unit.

35 Claims, 8 Drawing Figures

SADDLE COILS FOR ELECTROMAGNETIC DEFLECTION UNITS

BACKGROUND OF THE INVENTION

1. Field of the Invention

The invention relates to a method of forming a saddle coil for a deflection coil assembly which in use deflects the electron beam or beams of a cathode ray display tube in one of two orthogonal directions, in which a saddle coil is formed by a conductive pattern on assembled insulating film parts. The invention also relates to a method of forming deflection coil assemblies and electromagnetic deflection units, and also to saddle coils, deflection coils assemblies and deflection units per se.

2. Description of the Related Art

A number of proposals have been made in the past to replace the conventional wire wound saddle coils used for electromagnetic deflection with cathode ray tubes by coils manufactured by the so-called printed circuit or printed wiring techniques. Some of these proposals have related to such coils for use with television pick-up tubes where the coil shape is relatively simple and does not require the particular shaping problems encountered with the neck-cone shaping of television display tubes. UK Patent Specification No. 1,398,388 attempts to overcome this problem by producing two saddle coils on an assembly of two parts comprising a cylindrical part and an annular part both parts carrying conductors with the conductors on the annular part interconnecting the conductors on the cylindrical part. A saddle coil produced in this way does not readily lend itself to multiple layer construction due to difficulties in providing the required connections between the cylindrical and annular parts and where the above specification refers to more than one layer this in fact relates to two layers each of which carries the deflection coil for a different deflection direction. The limitation placed by the shaping of the parts and hence on the saddle coils so produced makes it only suitable for use as deflection coils for monochrome cathode ray display tubes of limited deflection angle. Thus such saddle coils are not suited to wide angle monochrome display tubes nor to colour display tubes where the required deflection field places particular constraints on the shaping and construction of the saddle coils.

SUMMARY OF THE INVENTION

It is an object of the invention to provide methods of constructing such coils and deflection units, the coils and deflection units so produced being suitable for use with wide angle monochrome and colour television display tubes.

The invention provides a method of forming a saddle coil for a deflection coil assembly which in use deflects the electron beam or beams of a cathode ray display tube in one of two orthogonal directions, the saddle coil comprising a plurality of layers of conductive pattern on assembled insulating film parts. The method comprises:

(i) producing for each layer a first substantially 'U' shaped lamelliform part and a second lamelliform part from insulating film with given conductive patterns on each part with the width of each part at any point being marginally greater than the width of the conductive pattern at that point, (ii) assembling the first part with the second part to form a layer by distorting the shape of the first part such that it is flared and bridging the distal ends of the first part with the second part so that the flared side limbs of the first part form the side members of the layer for the saddle coil with the transverse limb of the first part forming the gun end whilst the second part forms at least part of the screen end of the layer for the saddle coil, the conductive pattern on the second part providing the required interconnections between ends of the conductive pattern at the distal ends of the first part to form an electrical coil, (iii) assembling a plurality of layers so formed such that successive layers adhere to each other to form a substantially rigid and self-supporting saddle coil, and (iv) providing the required connections between the electrical coils of the various layers of said saddle coil.

The advantage of using printed wiring techniques to produce the coils of the various layers is that the conductors are accurately positioned on samples of the same saddle coil as well as that the equipment required for their manufacture is less expensive than that required for wire wound saddle coils.

The distal ends of said first 'U' shaped part may have projections which are turned in towards each other whilst the second part is also 'U' shaped with its side limbs being short relative to its transverse limb, the first part being assembled with the second part such that a portion of each side limb of the second part overlaps a portion of a respective projection on the first part. This makes it easier to connect the conductors of the first and second parts.

On assembly the conductive pattern on the second part may face the conductive pattern at the distal ends of the first part, so that the members of the conductive pattern on the second part may be welded to respective members of the conductive pattern on the first part.

The insulating film of said first and second parts may be provided with location holes, positioning of said first and second parts on assembly being achieved with the aid of such location holes whilst alignment of successive layers of said saddle coil can also be achieved with the aid of the location holes. This leads to accurate positioning between the various layers.

The invention also provides a method of forming a deflection coil assembly which in use deflects the electron beam or beams of a cathode ray display tube in one of two orthogonal directions. Such method comprises (i) forming first and second saddle coils by the method described above, and (ii) assembling the saddle coils so formed diagonally opposite each other around an imaginary cylinder having a diameter which is not less than that of the neck of the cathode ray display tube for which said deflection coil assembly is intended.

Although the saddle coils themselves are self-supporting this method may comprise the additional step of mounting the assembled first and second saddle coils on the inner face of a conical shaped support for positioning the saddle coils.

When the layers of the saddle coils are provided with location holes the first and second saddle coils may be positioned on assembly with the aid of these location holes to improve the positioning accuracy.

The invention further provides a method of forming an electromagnetic deflection unit comprising first and second deflection coil assemblies which in use deflects the electron beam or beams of a cathode ray display tube in respective orthoginal directions. Such method comprises (i) forming a first deflection coil assembly comprising a first pair of saddle coils by the method described above, (ii) forming a second pair of saddle coils by the method described above, (iii) assembling said second pair of saddle coils so formed diagonally opposite each other outside and at 90° to said first deflection coil assembly to form said second deflection coil assembly, and (iv) positioning a magnetic core around the assembled pairs of saddle coils to form said electromagnetic deflection unit.

The assembly of the first and second pairs of saddle coils may comprise the mounting thereof, respectively on the inner and outer faces of a conical shaped support for locating the relative positions of the saddle coils.

When the layers of the saddle coils are provided with location holes the conical support may be provided with locating pins on at least one of its faces, mounting of the respective pair of saddle coils being achieved by engagement of the locating pins with the location holes of the saddle coils. As an alternative the second pair of saddle coils may be bonded to the first pair of saddle coils. Each saddle coil of each pair may be provided with location holes, in which case the above method comprises the additional step of registering associated location holes in the first and second pairs of saddle coils to ensure correct positioning of the first deflection coil assembly with the second deflection coil assembly.

An alternative method of forming the electromagnetic deflection unit comprises (i) forming a first deflection coil assembly comprising a pair of saddle coils by the above method, (ii) toroidally winding a second deflection coil assembly about a magnetic core, and (iii) assembling the second deflection coil assembly at 90° to the first deflection coil assembly to form said deflection unit.

The assembly of the wound magnetic core and the first deflection coil assembly may comprise the steps of mounting the first pair of saddle coils on the inner face of a conical shaped support and mounting the wound magnetic core on the outer face of such support. As an alternative the first deflection coil assembly may be bonded to the wound magnetic core.

The invention also provides a method of forming an electromagnetic deflection unit comprising first and second deflection coil assemblies each of which comprises a first and second pair of saddle coils with each saddle coil being formed by a conductive pattern on assembled insulating film parts, comprising (i) producing for each of a plurality of layers of each saddle coil a first substantially 'U' shaped lamelliform part and a second lamelliform part from insulating film with given conductive patterns on each part, the first and second parts for one of the first pair of saddle coils having substantially the same shape as the respective first and second parts for the other of the said first pair whilst the first and second parts for one of the second pair of saddle coils have substantially the same shape as the respective first and second parts of the other of the said second pair, (ii) assembling for each saddle coil of each pair of saddle coils the first part with a second part to form a layer by distorting the shape of the first part such that it is flared and bridging the distal ends of the first part with the second part so that the transverse limb and the flared side limbs of the first part respectively from the gun end the second part forms at least part of the screen end of the layer for the saddle coil, the conductive pattern on the second part providing the required interconnections between ends of the conductive pattern at the distal ends of the first part to form an electrical coil, (iii) successively positioning the layers so formed for each of the pair of the first pair of saddle coils diametrically opposite each other, and successively positioning the layers so formed for each of the pair of the second pair of saddle coils diametrically opposite each other with the respective layers of the first pair of saddle coils being positioned rotationally at 90° in relation to the respective layers of the second pair of saddle coils and with the layers of the first pair of saddle coils interleaving the layers of the second pair of saddle coils, and adhering the layers from the first and second pairs of saddle coils to each other to form a substantially rigid and self-supporting assembly, (iv) providing the required electrical connections between layers of each pair of saddle coils and between the coils of each pair of saddle coils so formed to form the first and second deflection coil assemblies, and (v) positioning a magnetic core around the assembly of pairs of saddle coils to form said electromagnetic deflection unit.

A deflection coil produced by this method has the advantage that the line and field deflection coil assemblies can be accurately positioned relative to each other as well as reducing the transformer effect between the two deflection coil asemblies. Each part of each layer is provided with location holes which are employed to achieve the required positioning between the layers and hence the first and second deflection coil assemblies.

The invention further provides a saddle coil for a deflection coil assembly which in use deflects the electron beam or beass of a cathode ray display tube in one of two orthogonal directions, which saddle coil comprises a conductive pattern on assembled insulating film parts, characterised in that each saddle coil has a plurality of layers with each layer being formed from a first substantially 'U' shaped lamelliform part whose shape has been distorted such that it is flared and a second lamelliform part of insulating film with given conductive patterns on each part, the width of each part at any point being marginally greater than the width of the conductive pattern at that point, the distal ends of the first part being bridged by the second part such that the conductive pattern on the second part provides the required inter-connections between ends of the conductive pattern at the distal ends of the first part to form an electrical coil, a plurality of layers being adhered to each other to produce a substantially rigid and self-supporting saddle coil with the transverse limb and the flared side limbs of the first parts respectively forming the gun end and the side members of the saddle coil whilst the second parts form at least part of the screen end of the saddle coil, and with the required connections between the various layers of said saddle coil.

The distal ends of said first 'U' shaped part may have projections which are turned in towards each other whilst said second part is also 'U' shaped with side limbs which are short relative to its transverse limb, a portion of each side limb of the second part overlapping a portion of a respective projection on the first part.

Each layer the conductive pattern on the second part may face the conductive pattern at the distal ends of said part with members of the conductive pattern on the second part being welded to respective members of the conductive pattern on the first part.

In order to achieve accurate registration between the layers the insulating film of said first and second parts may contain location holes which are aligned in said saddle coil.

The invention also provides a deflection coil assembly which in use deflects the electron beam or beams of a cathode ray display tube in one of two orthogonal directions, characterised in that said deflection coil assembly comprises a first and a second saddle coil as above described positioned diagonally opposite each other around an imaginary cylinder having a diameter which is not less than that of the neck of the cathode ray display tube for which said deflection unit is intended.

Such an assembly may additionally comprise a conical shaped support against the inner face of which said first and second saddle coils are mounted.

Where the saddle coils are provided with location holes the first and second saddle coils may be positioned with the aid of these location holes.

The invention additionally comprises an electromagnetic deflection unit comprising first and second deflection coil assemblies which in use deflects the electron beam or beams of a cathode ray display tube in respective orthogonal directions, characterised in that said deflection unit comprises a first pair of saddle coils each as above described forming the first deflection coil assembly which coils are positioned diagonally opposite each other around an imaginary cylinder having a diameter which is not less than that of the neck of the cathode ray display tube for which said deflection unit is intended with a second pair of saddle coils each also as above described forming the second deflection coil assembly which coils are positioned diagonally opposite each other outside and at 90° to said first pair of saddle coils, and a magnetic core around the pair of saddle coils.

The unit may additionally comprise a conical shaped support with the first pair of saddle coils being mounted against the inner face of said support whilst the second pair of saddle coils are mounted against the outer face of said support. This support may be provided with locating pins on at least one of its faces which engage with corresponding location holes formed in the respective pair of saddle coils.

The first and second pairs of saddle coils may be bonded to each other and the correct positioning of said first and second pairs of saddle coils may be ensured by the registration of location holes in said saddle coils.

The invention yet further provides an electromagnetic deflection unit comprising first and second deflection coil assemblies which in use deflects the electron beam or beams of a cathode ray display tube in respective orthogonal directions, characterised in that said deflection unit comprises a pair of saddle coils each as above described forming the first deflection coil assembly which coils are positioned diagonally opposite each other around an imaginary cylinder having a diameter which is not less than that of the cathode ray display tube for which said deflection unit is intended, and a second deflection coil assembly toroidally wound about a magnetic core mounted on the first deflection coil assembly with the first deflection coil assembly being positioned at 90° to the second deflection coil assembly.

Such a deflection unit may additionally comprise a conical shaped support with the saddle coils mounted against the inner face of the support and the wound magnetic core mounted against the outer face of the support.

The first deflection coil assembly may be bonded to said wound magnetic core.

The invention additionally provides an electromagnetic deflection unit comprising first and second deflection coil assemblies which in use respectively deflect the electron beam or beams of a cathode ray display tube in respective orthogonal directions, said first and second deflection coil assemblies respectively comprising a first and second pair of saddle coils with each saddle coil being formed by a conductive pattern on assembled insulating film parts, characterised in that each saddle coil has a plurality of layers with each layer of each saddle coil being formed from a first substantially 'U' shaped lamelliform part whose shape has been distorted such that it is flared and a second lamelliform part from insulating film with given conductive patterns on each part, the first and second parts for one of the first pair of saddle coils having substantially the same shape as the respective first and second parts for the other of the said first pair whilst the first and second parts for one of the second pair of saddle coils have substantially the same shape as the respective first and second parts of the other of the said second pair, the distal ends of the first part being bridged by the second part so that the transverse limb and the side limbs of the first part respectively form the gun end and the flared side members of the layer for the saddle coil whilst the second part forms at least part of the screen end of the layer for the saddle coil, the conductive pattern on the second part providing the required inter-connections between ends of the conductive pattern at the distal ends of the first part to form an electrical coil, successive layers for each of the pair of the first pair of saddle coils being diametrically opposite each other, whilst successive layers for each of the pair of the second pair of saddle coils are diametrically opposite each other with the respective layers of the first pair of saddle coils being positioned rotationally at 90° in relation to the respective layers of the second pair of saddle coils and with the layers of the first pair of saddle coils interleaving the layers of the second pair of saddle coils, the layers from the first and second pairs of saddle coils being adhered to each other to form a substantially rigid and self-supporting assembly, the required electrical connections being present between layers of each pair of saddle coils and between the coils of each pair of saddle coils to form the first and second deflection coil assemblies, whilst a magnetic core surrounds the assembly of pairs of saddle coils to form said electromagnetic deflection unit.

Each saddle coil may be provided with location holes by means of which the required positioning of said first and second deflection coil assemblies is achieved.

BRIEF DESCRIPTION OF THE DRAWING

The above and other features will now be described, by way of example, with reference to the accompanying drawings, in which.

DESCRIPTION OF THE PREFERRED EMBODIMENTS

Figure 1:
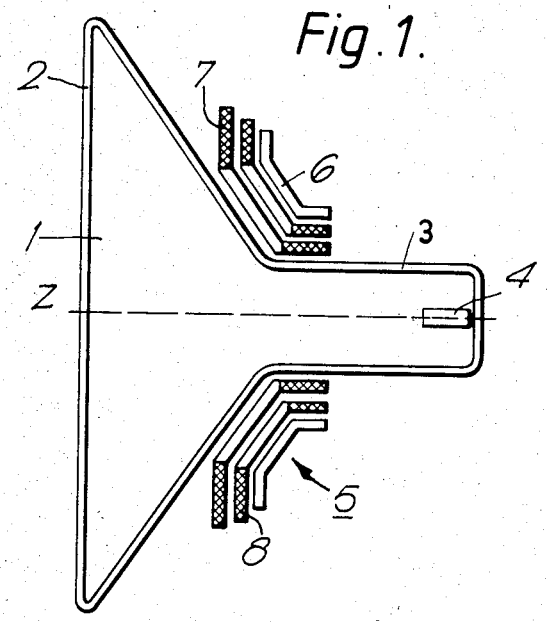
FIG. 1 is a diagrammatic sectional view of a colour display tube and electromagnetic deflection unit.

FIG. 1 is a longitudinal sectional view in diagrammatic form through a colour television display tube assembly whose longitudinal axis is indicated by Z, the display tube 1 having a display screen 2 at the conical end of the tube whilst the neck end 3 remote from the display screen contains three electron guns 4 situated in one plane, the longitudinal axis lying on the plane with the central electron gun on the axis. An electromagnetic deflection unit 5 is mounted on the display tube such that it surrounds a portion of the neck and a portion of the conical or flared part. This deflection unit 5 comprises a line deflection coil assembly 7 formed by a first pair of saddle coils and a field deflection coil assembly 8 formed by a second pair of saddle coils, the two coil assemblies being surrounded by a soft magnetic core 6 in the form of an annular flared ring. The two deflection coil assemblies are generally mounted on a support (not shown) of insulating material whose shape is substantially that of a frustrum. Each saddle coil is shown to be of the "shell" or "mussel" type which means that its end section adjacent the electron gun 4 (the gun end) is not bent away from the tube's neck and the longitudinal axis, as is the end section adjacent the B display screen 2 (the screen end), but lies parallel to the longitudinal axis Z. With such a type of saddle coil the core 6 may be formed as a single piece; if a saddle coil is bent at its gun end the core will have to be assembled from, typically, two parts which are clipped or bonded together.

Figure 2:
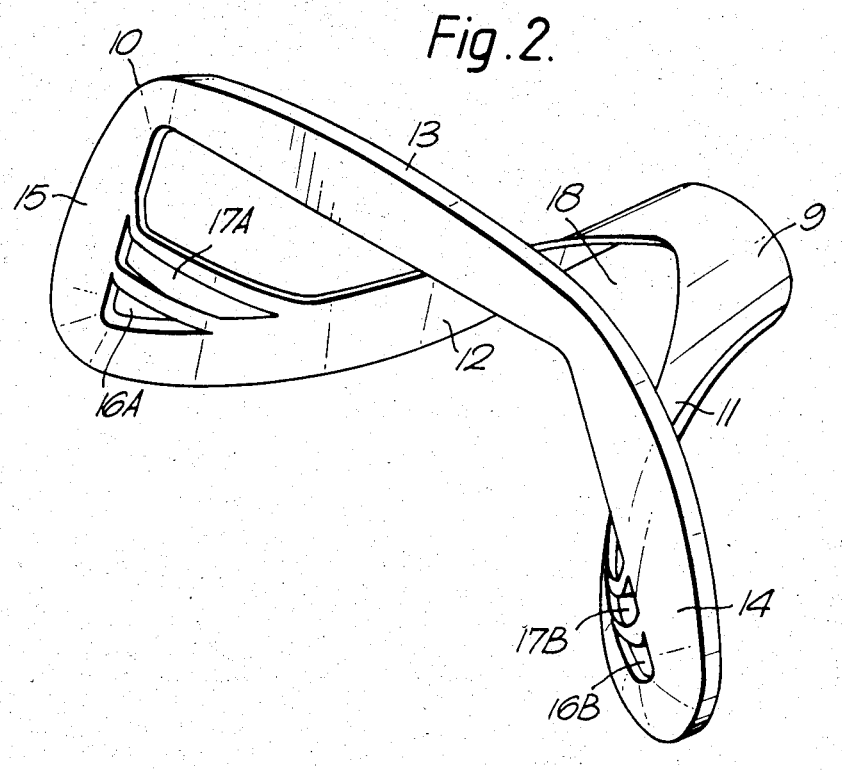
FIG. 2 is a perspective view of a known wire wound saddle coil for use in a deflection unit.

A typical saddle coil for the line deflection coil assembly for a current colour television display tube of screen size 22 inch and 110° deflection angle is shown in FIG. 2. In FIG. 2 the reference 9 indicates the gun end of the saddle coil whilst the screen end is indicated by the reference 10 whilst the references 11 and 12 indicate respective flared side members which join the gun 9 and screen 10 ends. The screen end 10 of the saddle coil comprises a transverse portion 13 and respective portions 14 and 15 by which the transverse portion 13 is joined to the respective side members 11 and 12. The regions between the side members 11, 12 and the associated portions 14,15 are wound in such a manner as to provide spaces in the winding, these spaces being indicated by the references 16A,16B,17A and 17B. Corresponding spaces may also be provided in the gun end 9 of the saddle coil. The gun 9 and screen 10 ends and the side members 11 and 12 define a window 18. A typical saddle coil of the field deflection coil assembly for such a display tube will be formed in a similar manner to that described save that the shape and proportions of the its various components will differ to that for the saddle coil of the line deflection coil assembly.

Saddle coils as described above are typically wound from copper wire of small dimension e.g. 0.5 mm diameter, the wire being coated with an electrical insulant and a thermo-setting adhesive. Winding takes place in special winding machines which wind the saddle coils substantially to their final shape and introduce the spaces adjacent the screen end (16A,16B,17A and 17B in FIG. 2) during the winding process, the shapes of these spaces being determined by retractable pins in the winding head which limits the shapes these spaces can take. Following winding each saddle coil is retained in a jig with pressure being applied to obtain the required mechanical dimensions, a current being passed through its turns to soften the thermo-setting adhesive which is afterwards allowed to cool to bond the wires of the winding together and form a self supporting saddle coil. It is quite obvious that such winding machines are extremely expensive and any minor winding variations between one machine and another can produce a variation in the deflection fields produced by the deflection units using such coils which need to be reproducably accurate for colour television display tubes.

Figure 3:
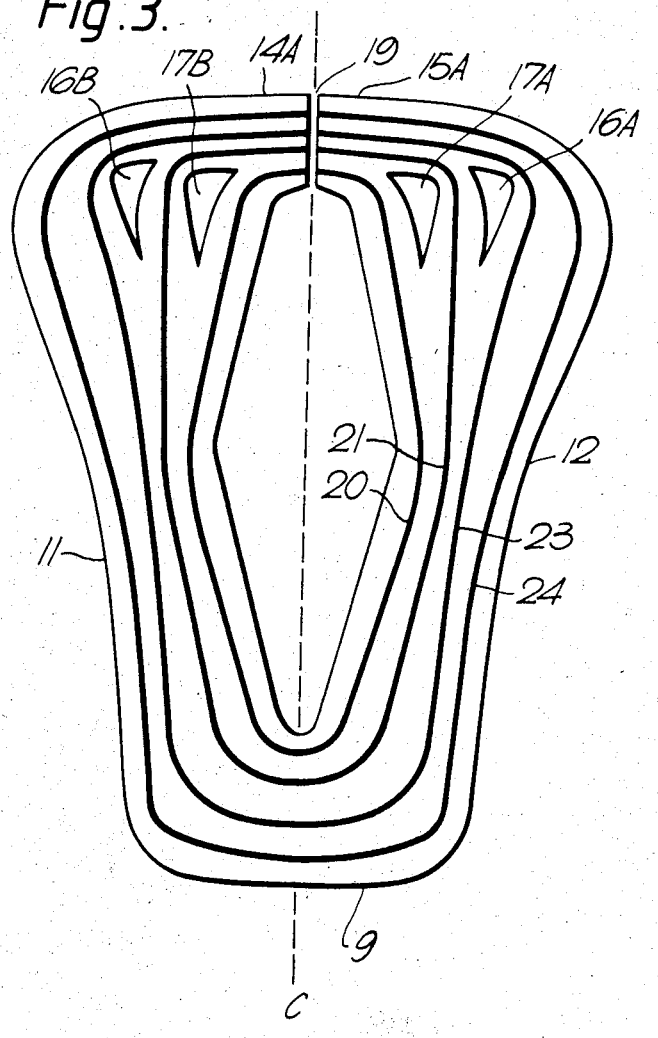
FIGS. 3 and 4 show parts for use with a saddle coil according to the invention.
Figure 4:
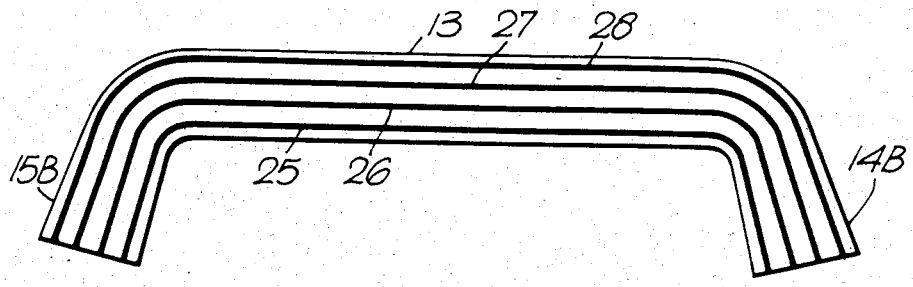

With the present invention each saddle coil, at least for the line deflection coil assembly, is produced from a plurality of layers of an insulating film which contain electrically conductive patterns usually of copper. Thus each layer forms a flexible printed circuit whose conductive pattern can be provided by one of the well known techniques for producing printed circuit wiring. As the shape required for the saddle coil as produced will be that of FIG. 2 or a shape which is similar to that, depending on the display tube the saddle coil is to be used with or whether it is for a line or field deflection coil assembly, it will be appreciated that each layer cannot be produced as a single piece from a flat lamelliform sheet of printed circuit film if the required shape is to be reliably reproduced. For that reason each layer is made up from first and second lamelliform parts which are respectively shown in FIGS. 3 and 4 with their electrical conductors uppermost. Most of the references used in these two figures refer to the corresponding portions of the saddle coil shown in FIG. 2 save that the portions 14 and 15 are divided and the divided portions indicated by the suffixes A and B. The first part shown in FIG. 3 is substantially 'U' shaped with the distal ends being turned in to form the portions 14A and 15A, the film being divided at 19. As will be seen from FIG. 3 the width of the first part at any point is only marginally greater than the width of the conductive pattern at that point. Some of the copper conductors present on this first part are indicated by the references 20,21,23 and 24 though it will be appreciated that other conductors will be present between these conductors. The second part shown in FIG. 4 is of shallow 'U' shape and forms a bridging member where the short side limbs form the portions 14B and 15B and the transverse limb forms the transverse portion 13, this second part also carrying copper conductors, four only of which 25, 26, 27 and 28 are shown though again it will be appreciated that others will be present between those shown, these conductors providing the neccessary connections between the conductors on the first part to produce an electrical coil which will be explained hereinafter.

Figure 5:
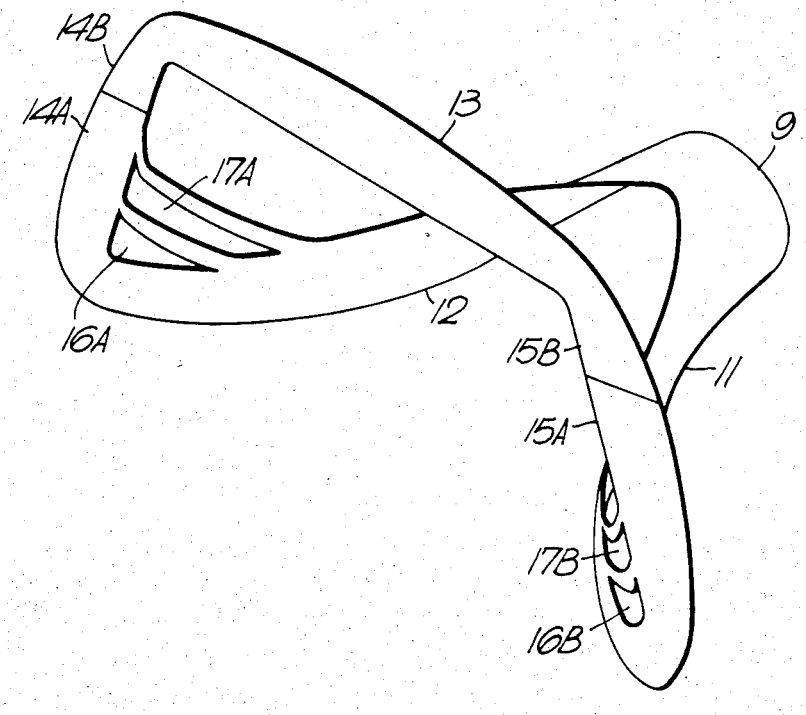
FIG. 5 is a perspective view of a layer of a saddle coil made from the parts of FIGS. 3 and 4, FIGS. 6 and 7 are portions on an enlarged scale of a portion of FIG. 5.

The first and second parts for each layer of the saddle coil are assembled in a jig such that the two parts are positioned in the manner shown in FIG. 5 with an overlap between parts 14A and 14B, and between 15A and 15B such that conductors on the first part are in contact and connected to conductors on the second part which may be suitably achieved by ultrasonic welding. Assembly is achieved by distorting the first part from the substantially 'U' shape it occupies in the flat to a substantially 'V' shape, accurate positioning of the two parts being achieved by the use of locating holes in the insulating film of the two parts either at suitable places where the conductors are suitably spaced or at additional places outside of the conductors. This first part is distorted such that its shape follows the relevant contour of the display tube about the transition from the neck to cone portions. Convenient places for locating holes in the first part could be the spaces 16A,16B,-17A,17B. It will be seen that the shape of the layer produced in FIG. 5 substantially corresponds to that of the saddle coil in FIG. 2. The complete saddle coil will be produced by assembling a number, say six, of such layers in a jig with suitable electrical interconnections between the layers to produce an electrical saddle coil. As the insulating film and conductors of each layer will be flexible a layer of adhesive, such as a cold or thermo-setting adhesive, will be provided between successive layers which can be applied by the use of a silk screen or other suitable mask. The adhesive between the layers on assembly will then be allowed to set, heat being required in the case of a thermo-setting adhesive which may be provided by an external source or by the application of a current of sufficient magnitude through the turns of the saddle coil so formed. Once the adhesive has set the assembly will form a rigid and self-supporting saddle coil which will be substantially the same shape as that shown for a wire wound saddle coil of FIG. 2. In such a saddle coil the transverse limb of the first part forms the gun end whilst the side limbs of the first part form the flared side members. The second part forms at least part of the screen end.

Figure 6:
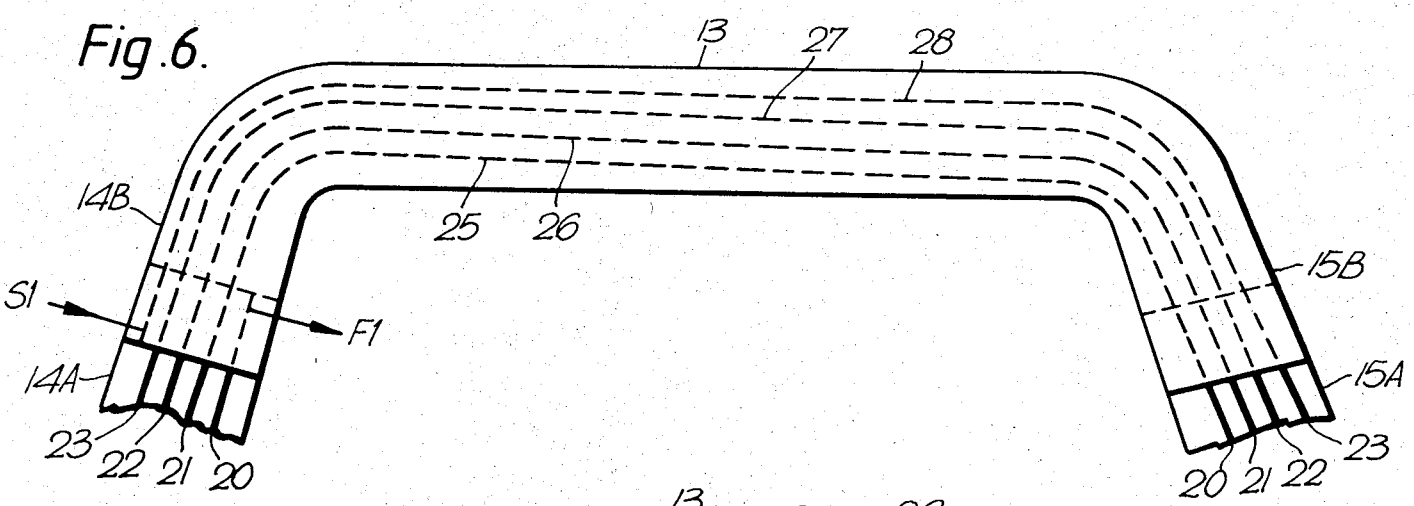
Figure 7:
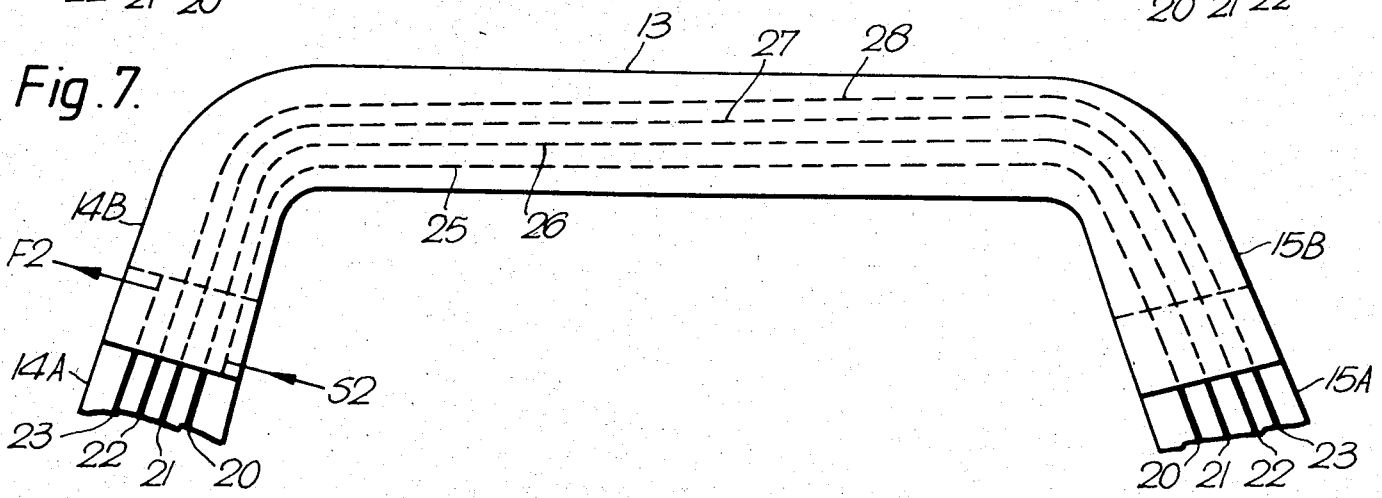

The conductive pattern on the first part of each layer as shown in FIG. 3 is symmetrical about the broken centre line C which passes through the division 19 and the middle of the gun end 9. The start and finish of the coil for each layer may be provided at the portion 14A where on assembly the overlap of the two parts occurs and the point at which the windings start and finish may alternate from layer to layer such that the deflection current flows from the outside towards the inside in (say) odd numbered layers and from the inside towards the outside in even numbered layers (as viewed in FIG. 3). This may be achieved by employing a conductive pattern on the first part for each layer which is substantially the sase for each layer with a conductive pattern for the second part which differs for the odd numbered layers compared with that for the even numbered layers. This is illustrated in FIGS. 6 and 7 which show the second part of a layer together with the portions 14A,15A of the first part. In these figures the conductors 25,26,27 and 28 are shown dotted on the second part as they are under the insulating foil as viewed whilst those on the first part are shown in continuous lines as they are on the top side of the insulating foil as viewed in these Figures. As will be seen from these Figures the portions 14B,15B respectively overlap the portions 14A,15A and certain conductors on these portions are welded to each other such as by ultrasonic welding. At the overlap between portions 15A and 15B the conductors 25,26,27 and 28 always respectively overlap and are welded to the conductors 20,21,22 and 23. The conductors of the two portions 14A,14B in FIG. 6 (which is, say, for odd numbered layers) do not completely overlap, conductors 25,26 and 27 on the second part respectively overlapping and being welded to conductors 21,22 and 23 on the first part. In FIG. 6 the start S1 of the coil to be formed is connected to conductor 28 on the second part whilst the finish F1 of the coil is taken from conductor 20 on the first part. In FIG. 7 (which will then be for even numbered layers) overlap of the conductors is again not complete at the portions 14A and 14B, with conductors 26,27 and 28 on the second part respectively overlapping and being welded to conductors 20,21 and 23 on the first part. In FIG. 7 the start S2 of the coil is connected to conductor 25 on the second part and the finish F2 is taken from conductor 23 on the first part. For successive layers the finish F1 of an odd numbered layer will be connected to the start S2 of the next even numbered layer, whilst the finish F2 of the an even numbered layer will be connected to the start S1 of the next odd numbered layer, and so on. In FIGS. 6 and 7, as before, only four conductors on the first and second parts have been shown for the sake of simplicity.

Figure 8:
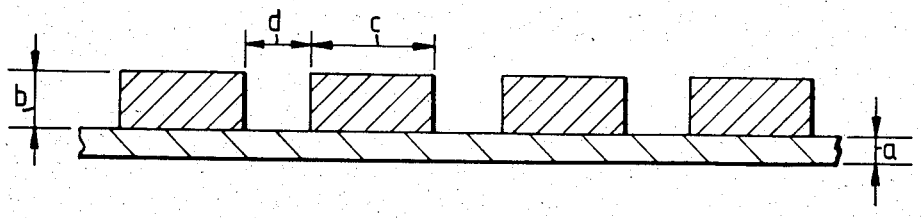
FIG. 8 is a section through a layer of material used with the invention.

As an example, a saddle coil according to the invention was designed to replace a wire wound saddle coil which had 144 turns of 0.5 mm diameter insulated copper wire. The replacement saddle coil was chosen to have six layers each layer of which had a coil of 24 turns formed in the manner shown in FIG. 8 where:

a—thickness of insulating film—0.1 to 0.2 mm
b—thickness of copper layer—0.3 mm
c—width of copper conductor—0.65 mm each
d—distance between conductors—0.35 mm.

With such dimensions it will be appreciated that the cross sectional area of each copper conductor substantially corresponds to that of a 0.5 mm diameter wire. Suitably materials for the film are polyester or polyimide sold under various trade names.

A pair of saddle coils produced in the manner described above may be employed as the line deflection coil assembly 7 of FIG. 1 and may be combined with a pair of saddle coils produced in a similar manner but of different dimensions which form the field deflection coil assembly 8 of that Figure. As an alternative the field deflection coil assembly may be toriodally wound around the core 6 in known manner.

With line and field deflection coil assemblies 7 and 8 assembled in conventional manner as diagrammatically shown in FIG. 1 the field deflection coil assembly is further from the electron beams than is the line deflection coil assembly so that the field coil assembly is less sensitive than the line coil assembly. When assemblng a deflection unit it is possible that the line coil assembly will not be in the precisely correct rotational position with respect to the field coil assembly whereby a transformer effect is produced between the two coil assemblies. Whilst rigidity and accurate rotational positioning could be achieved by the accurate location of the line and field saddle coils by means of accurately positioned location holes and subsequent bonding, with or without a support between the deflection coil assemblies, the problem of sensitivity may be overcome if instead of assembling each saddle coil separately from its individual layers the line and field deflection coil assemblies are produced as a single structure from the individual layers of the four saddle coils by interleaving the layers of the four saddle coils for the field deflection coil assembly between the layers of the saddle coils for the line deflection coil assembly. This may be achieved in a suitable jig with an adhesive applied between the various layers such that when the adhesive has set a rigid structure is achieved of the two deflection coil assemblies whose rotational positions are precisely defined, the accuracy of which will be to substantially reduce if not cancel the transformer effect between the two deflection coil assemblies. The interleaving of the saddle coil layers of the two deflection coil assemblies will increase the sensitivity of the field deflection coil assembly.

With the present invention the positioning of the (copper) electrically conductive turns can be very precisely controlled from the production of the two parts for each layer from the flat lamelliform material through to the finished saddle coil and assembly. Although not previously mentioned the dimensions of each successive layer may change slightly such that the outer layer is larger than the inter layer. Where the conductor turns on the first part of each layer are symmetrical and the interconnection is provided on the second part the accuracy of the deflection field generated by the side portions will be very high. Changing the direction of current flow in the coils between successive layers i.e. outer to inner for one layer and then inner to outer for the next layer, produces a cancelling effect on any magnetic field errors produced at the screen end of a saddle coil and hence on its deflection coil assembly.

It will be obvious that the saddle coils that can be produced by the above described methods may have shapes which differ to those illustrated. In addition the shapes of the spaces 16A,16B,17A and 17B may differ from those shown and may have shapes which could be achieved with saddle coils wound from wire only with extreme difficulty.

As stated in the above description the conductive pattern on each layer is formed by the techniques of printed circuit wiring and this is not limited to the more usual methods of starting with a film carrying a conductive layer which is etched to produce the required pattern but also includes techniques where the conductive pattern is applied and bonded to the film either from a strip or as a complete pattern.

I claim:

1. A method of forming a saddle coil for a deflection coil assembly which in use deflects the electron beam or beams of a cathode ray display tube in one of two orthogonal directions, the saddle coil comprising conductive patterns on assembled layers of insulating film parts, said method comprising the steps of:

(i) producing for each of said layers a first substantially 'U' shaped lamelliform part and a second lamelliform part from insulating film with patterns of conductive members on each part, the width of each part at any point being marginally greater than the width of the conductive pattern thereon at that point, (ii) assembling the first part with the second part to form a layer by distorting the shape of the first part such that it is flared and bridging the distal ends of the first part with the second part so that the flared side limbs of the first part form the side members of the layer for the saddle coil with the transverse limb of the first part forming the gun end whilst the second parts forms at least part of the screen end of the layer for the saddle coil, the conductive pattern on the second part providing the required interconnections between ends of the conductive pattern at the distal ends of the first part to form an electrical coil, (iii) assembling a plurality of layers so formed such that successive layers adhere to each other to form a substantially rigid and self-supporting saddle coil, and (iv) providing electrical connections between the conductive members of the various layers of said saddle coil.

2. A method as claimed in claim 1, characterised in that the distal ends of said first 'U' shaped part have projections which are turned in towards each other whilst said second part is also 'U' shaped with its side limbs being short relative to its transverse limb, and assembling the first part with the second part such that a portion of each side limb of the second part overlaps a portion of a respective projection on the first part.

3. A method as claimed in claim 1 or 2, characterised in that the parts are assembled so that the conductive pattern on the second part faces the conductive pattern at the distal ends of the first part, and welding respective members of the conductive pattern on the second part to respective members of the conductive pattern on the first part.

4. A method as claimed in claim 1 or 2, characterised in that the insulating films of said first and second parts of each of said layers are provided with location holes, positioning of said first and second parts for assembly of each layer and alignment of successive layers of said saddle coil being achieved by aligning said location holes.

5. A method of forming a deflection coil assembly which in use deflects the electron beam or beams of a cathode ray display tube in one of two orthogonal directions, said method comprising the steps of:

(i) forming first and second saddle coils by the method as claimed in claim 1 or 2, and (ii) assembling said first and second saddle coils so formed diagonally opposite each other around an imaginary cylinder having a diameter which is not less than that of the neck of said cathode ray display tube.

6. A method as claimed in claim 5, characterised in that said method comprises the additional step of mounting said assembled first and second saddle coils on the inner face of a conical shaped support.

7. A method of forming an electromagnetic deflection unit comprising first and second deflection coil assemblies which in use deflects the electron beam or beams of a cathode ray display tube in respective orthogonal directions, characterised in that said method comprises the steps of:

(i) forming a first and second pair of saddle coils by the method as claimed in claim 1, (ii) assembling said first pair of saddle coils diagonally opposite each other around an imaginary cylinder having a diameter which is not less than that of the neck of said cathode ray display tube to form said first deflection coil assembly, (iii) assembling said second pair of saddle coils diagonally opposite each other outside and at 90° to said first deflection coil assembly to form said second deflection coil assembly, and (iv) positioning a magnetic core around the assembled pairs of saddle coils to form said electromagnetic deflection unit.

8. A method as claimed in claim 7, characterised in that the assembly of said first and second pairs of saddle coils comprises the mounting thereof on the respective inner and outer faces of a conical shaped support.

9. A method as claimed in claim 8, characterized in that said support is provided with locating pins on at least one of its faces, mounting of the respective pairs of saddle coils being achieved by engagement of said locating pins with location holes in the insulating films of the layers of the saddle coils.

10. A method as in claim 7, characterised in that said method additionally comprises the step of bonding said second pair of saddle coils to said first pair of saddle coils.

11. A method as claimed in claim 10, characterised in that each saddle coil of each pair of saddle coils is provided with location holes, said method comprising the additional step of registering associated location holes in the first and second pairs of saddle coils to ensure correct positioning of the first deflection coil assembly with the second deflection coil assembly.

12. A method of forming an electromagnetic deflection unit comprising first and second deflection coil assemblies which in use deflects the electron beam or beams of a cathode ray tube in respective orthogonal directions, characterised in that said method comprises the steps of:

(i) forming a pair of saddle coils by the method as claimed in claim 1, (ii) assembling said pair of saddle coils diagonally opposite each other around an imaginary cylinder having a diameter which is not less than that of the neck of said cathode ray display tube to form said first deflection assembly, (iii) forming a second deflection coil assembly toroidally wound about a magnetic core, and (iv) assembling said first deflection coil assembly at 90° to the second deflection coil assembly to form said deflection unit.

13. A method as claimed in claim 12, characterised in that said assembly of said wound magnetic core and said first deflection coil assembly comprises the steps of mounting said pair of saddle coils on the inner face of a conical shaped support and mounting the wound magnetic core on the outer face of said support.

14. A method as claimed in claim 12, characterised in that said method additionally comprises the step of bonding said first deflection coil assembly to said wound magnetic core.

15. A method of forming an electromagnetic deflection unit comprising first and second deflection coil assemblies which in use respectively deflect the electron beam or beams of a cathode ray display tube in respective orthogonal directions, said first and second deflection coil assemblies respectively comprising a first and second pair of saddle coils with each saddle coil comprising conductive patterns on assembled layers of insulating film parts, comprising the steps of:

(i) producing for each of said layers of each saddle coil a first substantially 'U' shaped lamelliform part and a second lamelliform part from insulating film with patterns of conductive members on each part, the first and second parts for one of the first pair of saddle coils having substantially the same shape as the respective first and second parts for the other of the said first pair whilst the first and second parts for one of the second pair of saddle coils have substantially the same shape as the respective first and second parts of the other of the said second pair, (ii) assembling the first part of each layer with the second part thereof to form said layer by distorting the shape of the first part such that it is flared and bridging the distal ends of the first part with the second part so that the transverse limb and the flared side limbs of the first part respectively form the gun end and the side members of the layer for the saddle coil whilst the second part forms at least part of the screen end of the layer for the saddle coil, the conductive pattern on the second part providing the required inter-connections between ends of the conductive pattern at the distal ends of the first part to form an electrical coil, (iii) successively positioning the layers so formed of each of the first pair of saddle coils diametrically opposite each other, and successively positioning the layers so formed of each of the second pair of saddle coils diametrically opposite each other, the respective layers of the first pair of saddle coils being positioned rotationally at 90° in relation to the respective layers of the second pair of saddle coils and with the layers of the first pair of saddle coils interleaving the layers of the second pair of saddle coils, and adhering the layers of the first and second pairs of saddle coils to each other to form a substantially rigid and self-supporting assembly, (iv) providing electrical connections between the layers of each saddle coil and between each pair of saddle coils, thereby forming the first and second deflection coil assemblies, and (v) positioning a magnetic core around the assembled pairs of saddle coils to form said electromagnetic deflection unit.

16. A method as claimed in claim 15, characterised in that each layer of each part is provided with location holes which are employed to achieve the required positioning between the layers of each saddle coil and hence between the first and second deflection coil assemblies.

17. A saddle coil for a deflection coil assembly which in use deflects the electron beam or beams of a cathode ray display tube in one of two orthogonal directions, such saddle coil comprising: a plurality of layers respectively consisting of a first substantially 'U' shaped lamelliform part whose shape has been distorted such that it is flared and a second lamelliform part, each part being an insulating film with patterns of conductive members thereon, the width of each part at any point being marginally greater than the width of the conductive pattern at that point, the distal ends of the first part being bridged by the second part such that the conductive pattern on the second part provides the required interconnections between ends of the conductive pattern at the distal ends of the first part to form an electrical coil; said plurality of layers being adhered to each other to form a substantially rigid and self-supporting saddle coil in which the transverse limb and the flared side limbs of the first part respectively form the gun end and the side members of such saddle coil whilst the second part forms at least a portion of the screen end of such saddle coil; and electrical connections between said layers of said saddle coil.

18. A saddle coil as claimed in claim 17, characterised in that the distal ends of said first 'U' shaped part have projections which are turned in towards each other whilst said second part is also 'U' shaped with side limbs which are short relative to its transverse limb, a portion of each side limb of the second part overlapping a portion of a respective projection on the first part.

19. A saddle coil as claimed in claim 17 or 18, characterised in that for each layer the conductive pattern on the second part faces the conductive pattern at the distal ends of said first part and respective members of the conductive pattern on the second part being welded to respective members of the conductive pattern on the first part.

20. A saddle coil as claimed in claim 17 or 18 characterised in that the insulating films of said first and second parts contain location holes which are aligned in said saddle coil.

21. A deflection coil assembly which in use deflects the electron beam or beams of a cathode ray display tube in one of two orthogonal directions, characterised in that said deflection coil assembly comprises a first and a second saddle coil as claimed in claims 17 or 18, positioned diagonally opposite each other around an imaginary cylinder having a diameter which is not less than that of the neck of said cathode ray display tube.

22. A deflection coil assembly as claimed in claim 21, characterised in that said assembly additionally comprises a conical shaped support against the inner face of which said first and second saddle coils are mounted.

23. A deflection coil assembly as claimed in claim 21, characterised in that the insulating films of said first and second parts of each saddle coil contain location holes which are in alignment and which guide the positioning of the first and second saddle coils.

24. An electromagnetic deflection unit comprising first and second deflection coil assemblies which in use deflects the electron beam or beams of a cathode ray display tube in respective orthogonal directions, characterised in that said first deflection coil assembly comprises a first pair of saddle coils each as claimed in claim 17 or 18 which are positioned diagonally opposite each other around an imaginary cylinder having a diameter which is not less than that of the neck of said cathode ray display tube; said second deflection coil assembly comprises a second pair of saddle coils each as claimed in claim 17 or 18 which are positioned diagonally opposite each other outside and at 90° to said first pair of saddle coils; and a magnetic core around said pairs of saddle coils.

25. A deflection unit as claimed in claim 24, characterised in that said unit additionally comprises a conical shaped support, the first pair of saddle coils being mounted against the inner face of said support whilst the second pair of saddle coils are mounted against the outer face of said support.

26. A deflection unit as claimed in claim 25, characterised in that said support is provided with locating pins on at least one of its faces which engage with corresponding location holes formed in the respective pairs of saddle coils.

27. A deflection unit as claimed in claim 24, characterised in that said first and second pairs of saddle coils are bonded to each other.

28. A deflection unit as claimed in claim 27, characterised in that correct positioning of said first and second pairs of saddle coils is ensured by the registration of location holes in said saddle coils.

29. An electromagnetic deflection unit comprising first and second deflection coil assemblies which in use deflects the electron beam or beams of a cathode ray display tube in respective orthogonal directions, characterised in that said first deflection coil assembly comprises a pair of saddle coils each as claimed in claim 17 or 18 which are positioned diagonally opposite each other around an imaginary cylinder having a diameter which is not less than that of said cathode ray display tube; said second deflection coil assembly is toroidally wound about a magnetic core; and said second deflection coil assembly is mounted on said first deflection coil assembly positioned at 90° with respect thereto.

30. A deflection unit as claimed in claim 29, characterised in that said deflection unit additionally comprises a conical shaped support having an inner and outer face, said saddle coils being mounted against the inner face of said support and said wound magnetic core being mounted against the outer face of said support.

31. A deflection unit as claimed in claim 29, characterised in that said first deflection coil assembly is bonded to said wound magnetic core.

32. An electromagnetic deflection unit comprising first and second deflection coil assemblies which in use respectively deflect the electron beam or beams of a cathode ray display tube in respective orthogonal directions, said first and second deflection coil assemblies respectively comprising a first and second pair of saddle coils, characterised in that: each saddle coil consists of a plurality of layers each layer of which comprises a first substantially 'U' shaped lamelliform part whose shape has been distorted such that it is flared and a second lamelliform part, each part being an insulating film with patterns of conductive members thereon; the first and second parts of each saddle coil in each of said pairs respectively being of substantially the same shape as the first and second parts of the other saddle coil in such pair, the distal ends of the first part of each layer being bridged by the second part thereof so that the transverse limb and the flared side limbs of the first part respectively form the gun end and the side members of such layer of the saddle coil whilst the second part forms at least part of the screen end of such layer of the saddle coil, the conductive pattern on the second part providing the required inter-connections between the ends of the conductive pattern at the distal ends of the first part to form an electrical coil; successive layers of each of the first pair of saddle coils being diametrically opposite each other and successive layers of each of the second pair of saddle coils being diametrically opposite each other; the respective layers of the first pair of saddle coils being positioned rotationally at 90° in relation to the respective layers of the second pair of saddle coils and with the layers of the first pair of saddle coils interleaving the layers of the second pair of saddle coils; the layers of the first and second pairs of saddle coils being adhered to each other to form a substantially rigid and self-supporting assembly; electrical connections between the layers of each pair of saddle coils and between the coils of each pair of saddle coils of the first and second deflection coil assemblies; and a magnetic core surrounding the assembled pairs of saddle coils to form said electromagnetic deflection unit.

33. A deflection unit as claimed in claim 32, characterised in that the layers of each saddle coil comprise location holes by means of which the required positioning of said first and second deflection coil assemblies is achieved.

34. A method as claimed in claim 3, characterized in that the insulating films of said first and second parts are provided with location holes, positioning of said first and second parts for assembly of each layer and alignment of successive layers of said saddle coil being achieved by aligning said location holes.

35. A method as claimed in claim 5, characterized in that the insulating films of said first and second parts of each of said layers are provided with location holes, positioning of said first and second parts for assembly of each layer and alignment of successive layers of said saddle coil being achieved by aligning said location holes; and positioning of said first and second saddle coils for assembly being achieved by aligning said location holes.

* * * * *